United States Patent [19]

Bersch

[11] Patent Number: 4,607,410

[45] Date of Patent: Aug. 26, 1986

[54] APPARATUS FOR CLEANING PIPELINES FOR BEVERAGES AND THE LIKE

[76] Inventor: Friedrich Bersch, Industriestrasse 18, D-5401 Halsenbach, Fed. Rep. of Germany

[21] Appl. No.: 684,452

[22] Filed: Dec. 21, 1984

[30] Foreign Application Priority Data

Dec. 24, 1983 [DE] Fed. Rep. of Germany ..... 3347004

[51] Int. Cl.[4] ..... B08B 9/02

[52] U.S. Cl. ..... 15/3.51; 15/104.06 A

[58] Field of Search ..... 15/3.51, 3.5, 104.06 A

[56] References Cited

U.S. PATENT DOCUMENTS

| | | | |
|---|---|---|---|
| 1,165,455 | 12/1915 | Schlemmer | 15/3.51 |
| 2,074,187 | 3/1937 | Pichler et al. | 15/3.51 |
| 2,096,714 | 10/1937 | Haldane | 15/3.51 |

FOREIGN PATENT DOCUMENTS

| | | | |
|---|---|---|---|
| 1782136 | 5/1978 | Fed. Rep. of Germany | 15/3.51 |
| 2312175 | 12/1976 | France | 15/3.51 |

*Primary Examiner*—Edward L. Roberts

*Attorney, Agent, or Firm*—Peter K. Kontler

[57] ABSTRACT

Apparatus for cleaning pipelines of finite length has a four-way flow reversing valve whose body admits a liquid cleaning agent from an inlet into one port and thence into a pipeline whence the cleaning agent flows back into the body by way of a second port and is discharged by way of an outlet. The valving element is a piston which is reciprocable between two end positions in one of which the flow of cleaning agent takes place as outlined above and in the other of which the cleaning agent flows first into the other port and returns into the body of the valve by way of the one port to be discharged by way of the outlet. The body of the valve is separably connected with the larger-diameter end portions of two cylindrical housings whose smaller-diameter end portions are separably connectable with the respective ends of the pipeline. A supply of cleaning elements, such as balls of sponge rubber, is used in the apparatus to automatically change the position of the piston as soon as they impinge upon the one or the other end of the piston.

17 Claims, 5 Drawing Figures

APPARATUS FOR CLEANING PIPELINES FOR BEVERAGES AND THE LIKE

BACKGROUND OF THE INVENTION

The present invention relates to apparatus for cleaning pipelines, especially for cleaning flexible and/or rigid conduits for beer and/or other beverages. More particularly, the invention relates to improvements in apparatus for cleaning pipelines by means of a liquid cleaning agent in conjunction with discrete cleaning elements in the form of small spherical sponges, glass balls, pieces of synthetic plastic material or the like. Still more particularly, the invention relates to improvements in cleaning apparatus of the type wherein the direction of flow of cleaning agent and cleaning elements through a pipeline can be reversed by a four-way valve.

Commonly owned German Auslegeschrift No. 17 82 136 discloses a cleaning apparatus wherein a reversible four-way valve has a body with an inlet for fresh cleaning agent, an outlet for spent cleaning agent and two ports which can be connected with the ends of a pipeline. The valving element is a reciprocable piston which can be shifted back and forth by a set of cleaning elements which travel through the pipeline to impinge upon one end face of the piston whereby the piston is caused to change its position and to change the direction of flow of cleaning agent through the pipeline. The cleaning elements then impinge upon the other end face of the piston with a renewed change in the position of the piston. The same procedure is repeated again and again until the cleaning operation is completed. In one of its positions, the piston causes the cleaning agent to flow from the inlet into one of the ports, through the pipeline, through the other port and into the outlet. When in the other position, the piston causes the freshly admitted cleaning agent to flow into the other port, through the pipeline, back into the body of the valve through the one port and into the outlet. The cleaning elements migrate back and forth by advancing through the pipeline from one end face of the piston to the other end face, back to the one end face and so on. The apparatus which is disclosed in the German publication further comprises at least one housing with a larger-diameter end attached to the body of the valve so as to communicate with one of the ports, and a smaller-diameter end connected to the respective end of a pipeline which requires cleaning. The pipeline is a flexible conduit or a rigid tube of finite length (at least in the course of the cleaning operation) and each of its ends is communicatively connected with a different port of the valve body prior to start of the cleaning operation. As a rule, the cleaning agent is water which is supplied to the inlet by a faucet with the interposition of a suitable supply conduit. Spent cleaning agent which leaves the body of the valve by way of the outlet can be discharged into a sink or the like. The pressure of cleaning agent suffices to entrain the cleaning elements which impinge upon filters, one at each end of the piston, so that the flow of liquid cleaning agent through the one filter is reduced accordingly with the attendant buildup of liquid pressure which causes the piston to move to the other position. Thus, the cleaning elements initiate a shifting in the position of the piston whenever they complete their travel through the pipeline.

The aforementioned housings of the cleaning apparatus which is disclosed in the German publication comprise cylinders which are made of glass and are connected to the body of the valve, and flanges which are connected with the respective ends of the pipeline. Each flange is connected to the body of the valve by means of several screws or bolts so that each cylinder is confined between the valve body and the respective flange. Each flange has an externally threaded nipple which can be connected with the respective end of the pipeline by a manually operated coupling device. The cleaning elements are normally relatively small spheres which are made of foam rubber or the like and whose diameters are at least slightly smaller than the inner diameter of the pipeline. The inner diameter of each of the aforementioned nipples matches or approximates the inner diameter of the respective end of the pipeline.

When a cleaning operation is completed, the operator dismantles one of the housings by detaching the respective flange from the body of the four-way valve so as to gain access to the cleaning elements in the respective glass cylinder. The thus removed cleaning elements must be stored in a separate place for renewed use. Such cumbersome and time-consuming treatment of cleaning elements upon completion of each cleaning operation is considered necessary in order to avoid partial or complete drying of the cleaning elements after the cleaning agent has been drained out of the apparatus. Dried or partially dried cleaning elements could gather bacteria from the surrounding atmosphere and could contaminate the cleaning agent in the course of the next cleaning operation. As a rule, the cleaning elements must be extracted by a specially designed tool, especially if they are to be removed while still in expanded (moist or wet) condition.

Removal of impurities which gather along the outer sides of the aforementioned filters also presents numerous problems and is a time-consuming operation. Still further, the just described conventional apparatus is designed for the cleaning of pipelines with ends having a predetermined inner diameter. If the inner diameters of the ends of a pipeline are different, it is necessary to employ a second apparatus with housings including flanges having nipples of appropriate size so as to be connectable to the ends of the pipeline. This means that, when the pipelines for the conveying of beer and/or other beverages in a restaurant, bar or a similar establishment require cleaning, the agency in charge of cleaning must send at least two different apparatus, or the owner of the establishment must purchase several apparatus, because pipelines which convey beer from the barrels to the taps often employ hoses or tubes having an inner diameter in the range of 7 mm in contrast to the conduits for alcohol-free beverages whose diameter is normally in the range of 10 mm.

A somewhat similar apparatus was offered for sale under the name "Fasil" by Friedrich Hueber, Munich, German Federal Republic. This apparatus employed a manually operated valve for reversing the direction of flow of a liquid cleaning agent through the pipeline. The cleaning elements had to be inserted into one of the glass housings prior to start of each cleaning operation.

OBJECTS AND SUMMARY OF THE INVENTION

An object of the invention is to provide a novel and improved cleaning apparatus which is constructed and assembled in such a way that the cleaning elements need not be removed upon completion of a cleaning operation.

Another object of the invention is to provide a cleaning apparatus whose versatility exceeds that of heretofore known cleaning apparatus.

A further object of the invention is to provide a cleaning apparatus which can be put to use with little loss in time and which need not be furnished with special tools for removal of cleaning elements upon completion of each cleaning operation.

An additional object of the invention is to provide novel and improved housings for use in the cleaning apparatus.

Still another object of the invention is to provide the cleaning apparatus with novel and improved means for sterilizing the cleaning elements in the apparatus proper and for maintaining the cleaning elements in sterilized condition during the intervals between successive cleaning operations.

Another object of the invention is to provide a novel and improved cleaning apparatus which can be used for the cleaning of pipelines having any one of a wide variety of different inner diameters.

A further object of the invention is to provide the cleaning apparatus with novel and improved means for gathering and storing cleaning elements adjacent to the valve which controls the direction of flow of liquid cleaning agent through a pipeline.

One feature of the invention resides in the provision of an apparatus for cleaning pipelines of finite length by means of a liquid cleaning agent and discrete cleaning elements in the form of spherical sponges or the like. The apparatus comprises a four-way reversing valve including a body having an inlet for a fresh cleaning agent (e.g., tap water), an outlet for spent cleaning agent and two ports which serve to communicate with the ends of a pipeline which requires cleaning. The valve further comprises a valving element which is movable in the body between a first position in which the inlet and the outlet respectively communicate with one and the other port and a second position in which the inlet and the outlet respectively communicate with the other port and the one port. The apparatus further comprises at least one housing defining a chamber for temporary storage of a supply of cleaning elements and having a first opening which affords access to the chamber and a second opening which provides a path for the flow of cleaning agent and for migration of cleaning elements between the chamber and one end of the pipeline, means for separably and sealingly coupling the housing to the valve so that the chamber communicates with one of the ports by way of the first opening, and means for selectively sealing and unsealing the second opening so that, by the simple expedient of sealing the second opening and maintaining the first opening at a level above the second opening, the supply of cleaning elements in the chamber can be at least partially submerged in a liquid medium, such as fresh cleaning agent or a specially selected sterilizing liquid. The means for selectively sealing and unsealing the second opening can comprise a conventional shutoff valve which is installed in the housing. If the liquid medium is a liquid other than the cleaning agent, such medium can be introduced into the housing by way of the first opening on separation of the housing from the valve. The housing can be provided with a nipple or a like end portion which defines the second opening and is connectable with one end of the pipeline. In order to ensure or facilitate convenient manipulation, the housing is preferably elongated and its length preferably at least equals or exceeds ten centimeters. Also, the housing can be provided with one or more longitudinally extending external ribs.

Another feature of the invention resides in the provision of a cleaning apparatus which has a four-way valve of the above described type and a housing including a first end portion with an inner diameter larger than and a second end portion with an inner diameter closer (and preferably equal or nearly equal) to the inner diameters of the ends of the pipeline which requires cleaning. Such apparatus further comprises preferably manually operated means for releasably coupling the first end portion of the housing to the valve so that the interior of the housing (i.e., the aforementioned chamber) communicates with one of the ports in the body of the four-way valve. The second end portion of the housing is connectable with one end of the pipeline which requires cleaning. The first end portion defines the aforementioned first opening of the housing and is preferably located at a level above the second end portion which preferably contains the aforementioned shutoff valve. Thus, and as explained above, a requisite quantity of a suitable sterilizing liquid or another liquid medium can be introduced into the housing upon detachment of its first end portion from the four-way valve so that the cleaning elements in the housing can be submerged in the liquid medium as long as the shutoff valve in the second end portion of the housing remains closed.

The valving element preferably includes a piston which is reciprocable in the body of the four-way valve, and the coupling means is preferably designed to connect the first end portion of the housing directly with the body of the four-way valve. The coupling means preferably defines for the cleaning agent and for the cleaning elements a passage with a diameter which at least matches the diameter of the piston. This enables a substantial number of cleaning elements to come into contact with and to obstruct the flow of cleaning agent through the filter at the respective end of the piston.

The coupling means can comprise a quick-release coupling which is preferably designed to separably secure the first end portion of the housing to the body of the four-way valve in response to movement of the housing with reference to the valve. For example, the quick-release coupling can comprise a bayonet mount and the housing can include a cylinder which must be rotated in a first direction in order to attach the housing to the body of the four-way valve and in a second direction to detach the housing from the body. For example, the bayonet mount can include a flange which is provided on the body of the four-way valve, which surrounds the one port, and which has a set of circumferentially spaced-apart slots. Such bayonet mount further includes a plurality of hook-shaped prongs provided on the first end portion of the housing and being insertable through the slots of the flange in at least one predetermined angular position of the cylinder with reference to the four-way valve. Each hook-shaped prong engages the flange from behind in response to rotation of the cylinder from the one predetermined angular position while the prongs extend through the respective slots of the flange.

The entire housing can be made of a single piece of suitable material (e.g., a transparent or translucent synthetic plastic substance), and the second end portion of the housing can constitute a nipple which is connectable (either directly or indirectly) with one end of the pipeline which requires cleaning. The coupling means is preferably closely adjacent to one end face of the piston, at least when the latter assumes one of its positions with reference to the body of the four-way valve. The apparatus can comprise a second housing which is identical with the first named housing and second coupling means for separably but sealingly connecting the first end portion of the second housing to the body of the valve so that the interior of the second housing communicates with the other port. The second end portion of the second housing is connectable with the other end of the pipeline which requires cleaning.

If the apparatus is to be used for the cleaning of pipelines having end portions of different diameters, it is supplied with at least one spare housing having a first end portion with an inner diameter matching the inner diameter of the first named housing and a second end portion with an inner diameter deviating from the inner diameter of the second end portion of the first named housing. This renders it possible to simply exchange the housings so as to ensure that the second end portion of the selected housing can be properly attached to one end of the pipeline. For example, the second end portion of one of the housings can be connected to one end of a pipeline having an inner diameter in the range of 7 mm, and the second end portion of another housing can have an inner diameter in the range of 10 mm so that it can be connected with one end of a pipeline which serves for the conveying of nonalcoholic beverages.

The novel features which are considered as characteristic of the invention are set forth in particular in the appended claims. The improved cleaning apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
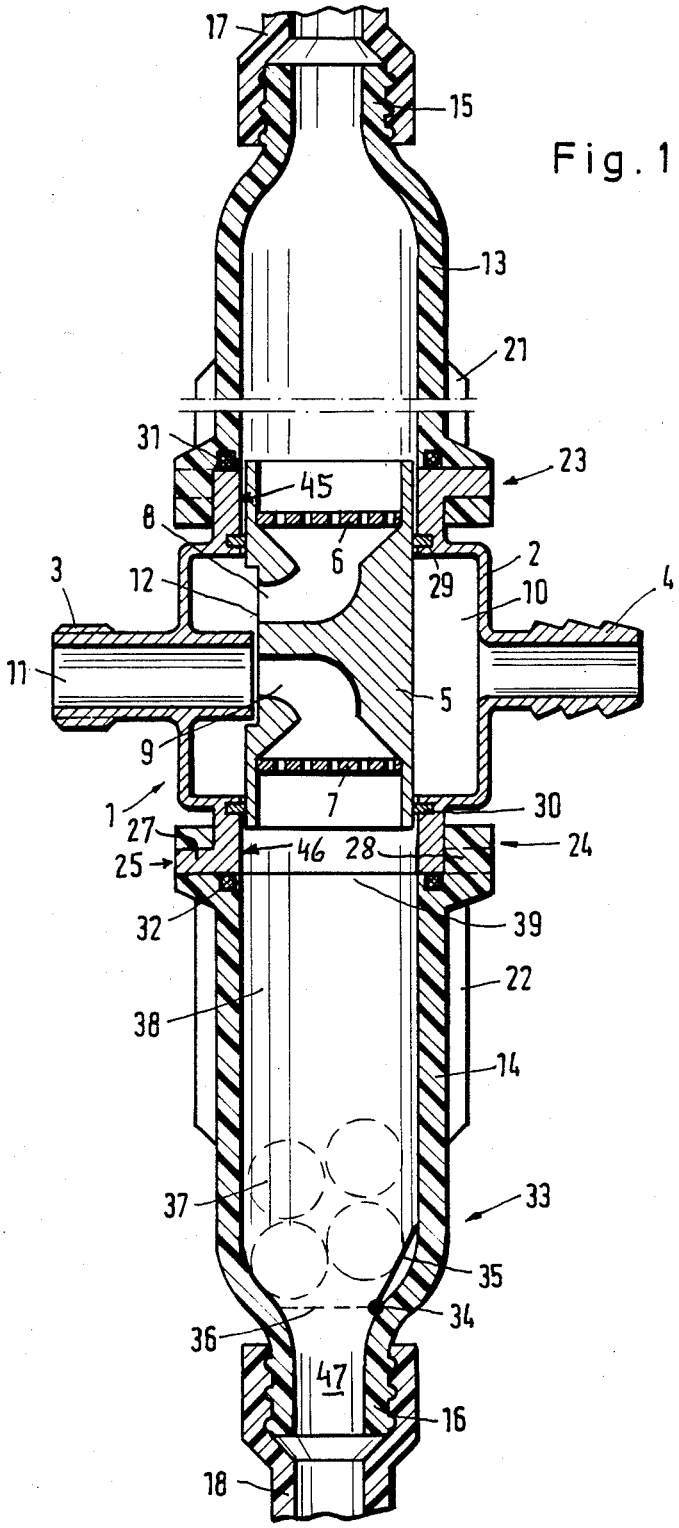
FIG. 1 is a central longitudinal vertical sectional view of a cleaning apparatus which embodies one form of the invention.

Referring first to FIG. 1, there is shown a cleaning apparatus which comprises a four-way flow reversing valve 1 including a housing or body 2 with an inlet 3, an outlet 4 and two ports 45, 46. The valve 1 further comprises a valving element 5 in the form of a cylindrical or substantially cylindrical piston which is reciprocable between the illustrated (upper) end position and a second (lower) end position. The end faces of the piston 5 are defined by the outer sides of two flat plate-like filters or sieves 6 and 7 which are recessed into the piston and serve to intercept impurities as well as substantially spherical cleaning elements 37 which are indicated by broken lines. The piston 5 is formed with a first passage or channel 8 one end of which is located behind the filter 6 and the other end of which communicates with an annular compartment 10 of the housing 2 or with the axial passage 11 of the inlet 3, and with a second passage or channel 9 one end of which is located behind the filter 7 and the other end of which communicates with the axial passage 11 of the inlet 3 or with the annular compartment 10. The upper end portion of the body 2, as viewed in FIG. 1, is connected with a first elongated cylindrical housing 13 which is separably connected with one end 17 of a pipeline when the latter is to be cleaned and during actual cleaning. A second cylindrical housing 14 is connected to the lower end portion of the body 2 and its lower end portion is separably connected to the other end 18 of the pipeline which requires cleaning. In the illustrated end position of the piston 5, a liquid cleaning agent (e.g., tap water) flows from the axial passage 11 of the inlet 3 into the channel 9 of the piston 5, through the interstices of the filter 7, through the lower housing 14, into the end 18 of the pipeline (whereby the cleaning agent entrains the cleaning elements 37), through the pipeline, into the housing 13 by way of the end 17 of the pipeline, through the interstices of the filter 6, through the channel 8 of the piston 5, through the annular compartment 10 of the body 2, and into the outlet 4 which can discharge spent (i.e., contaminated) cleaning agent into a sink or into a collecting receptacle, depending upon whether or not the cleaning agent is to be regenerated and reused. The cleaning elements 37 advance with the cleaning agent and impinge upon the outer side of the filter 6 when they have completed their travel through the pipeline in a direction from the end 18 toward the end 17. These cleaning elements impede or terminate the flow of cleaning agent through the interstices of the filter 6 so that they cause the cleaning agent to shift the piston 5 to the other (lower) end position whereby the cleaning agent flows in the opposite direction, i.e., from the axial passage 11 of the inlet 3, through the channel 8, filter 6, housing 13 (to entrain the cleaning elements 37), through the pipeline in a direction from the end 17 toward the end 18, through the housing 14, filter 7, channel 9, compartment 10 and outlet 4. The cleaning elements 37 ultimately impinge upon and clog the interstices of the filter 7 so that the piston 5 is shifted back to the illustrated end position whereby the cleaning agent again flows first into the housing 14, through the pipeline and into the outlet 4 via housing 13. The same procedure is repeated again and again, as often as necessary, in order to complete the cleaning operation.

The external surface of the piston 5 has an elongated groove 12 which receives the innermost portion of the inlet 3 so that the latter determines the extent to which the piston can be shifted between its two end positions.

Each of the housings 13, 14 preferably consists (at least in part) of a transparent or translucent synthetic plastic material so that the operator can ascertain which of these housings contains the supply of cleaning elements 37. The cleaning elements 37 can be made of sponge rubber or they may constitute or include glass balls, discrete balls or otherwise configurated particulate elements made of a synthetic plastic material and- /or a combination of different types of cleaning elements whose maximum transverse dimensions do not exceed the inner diameter of the pipeline including the ends 17 and 18. Each of the housings 13, 14 has a first end portion which is separably coupled to the body 2 of the valve 1 and has a relatively large inner diameter, and a second end portion which is separably connected with the respective end of the pipeline. The second end portion 15 of the upper housing 13 is an externally threaded nipple whose inner diameter matches or closely approximates the inner diameter of the end 17 and which is threadedly connected with the end 17 so as to allow for unimpeded flow of cleaning agent from the internal chamber of the housing 13 into the pipeline or the other way around as well as for unimpeded or substantially unimpeded passage of the cleaning elements 37 from the pipeline into the housing 13 or vice versa. The second end portion 16 of the lower housing 14 also constitutes an externally threaded nipple which is separably connected with the respective end 18 of the pipeline and whose inner diameter matches or approximates the inner diameter of the end 18.

Figure 2:
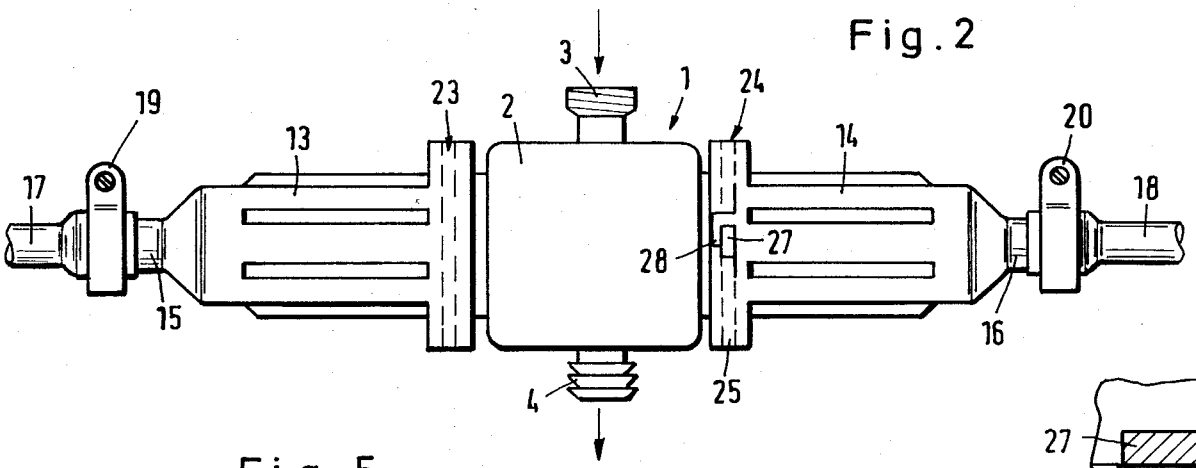
FIG. 2 is an elevational view of a modified cleaning apparatus.

If desired, the external threads of the nipples 15, 16 and the internal threads of the ends 17, 18 of the pipeline can be omitted if the maker of the apparatus decides to connect the second end portions of the housings 13, 14 with the respective ends of the pipeline by means of conventional or specially designed hose clamps of the type shown in FIG. 2, as at 19 and 20. The end portions 15, 16 (without external threads) are then simply slipped into the respective (non-tapped) ends 17, 18 of the pipeline and the clamps 19, 20 are applied to ensure the establishment of leakproof connections between the apparatus and both ends of the pipeline. Of course, it is also possible to use externally threaded end portions 15, 16, internally threaded ends 17, 18 and the hose clamps 19, 20.

In order to facilitate the manipulation of the improved apparatus (namely the attachment of the housings 13, 14 to and their detachment from the valve body 2 as well as the end portions placing the 15, 16 into or out of mesh with the ends 17, 18 of the pipeline), the housings 13, 14 are preferably elongated and their external surfaces are preferably provided with one or more elongated ribs 21, 22 which extend from the larger-diameter first end portions toward the smaller-diameter second end portions or nipples 15, 16 of the respective housings. The length of each of the housings 13, 14 is preferably not less than 10 cm.

The larger-diameter first end portion of the upper housing 13 is separably but sealingly connected to the body 2 of the four-way valve 1 by a quick-release coupling 23. A similar coupling 24 is provided to separably and sealingly connect the larger-diameter upper end portion of the housing 14 to the lower end of the valve body 2. When the housings 13 and 14 are properly coupled to the body 2, the internal chamber of the upper housing 13 communicates with the port 45 and the internal chamber 38 of the lower housing 14 communicates with the port 46 of the body 2. The diameters of the filters 6, 7 (i.e., of the end faces of the piston 5) are smaller than or at most equal the inner diameters of the first end portions of the housings 13 and 14. The opening in the first end portion of the lower housing 14 is shown at 39, and the diameter of this opening at least matches the maximum diameter of the lower end of the piston 5. The couplings 23, 24 are preferably designed in such a way that each thereof can be applied or disengaged by hand and with little loss in time.

Figure 3:
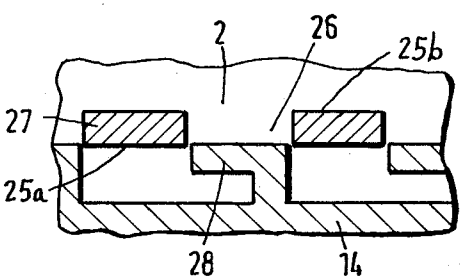
FIG. 3 is a fragmentary schematic developed sectional view of one of the coupling means in open position.
Figure 4:
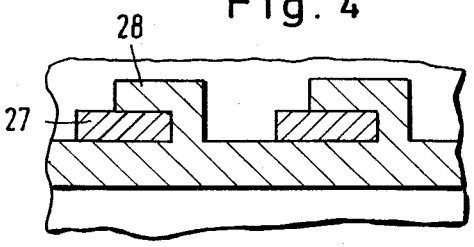
FIG. 4 illustrates the structure of FIG. 3 but with the coupling means in closed or sealing position.

The construction of the coupling 24 between the upper end portion of the housing 14 and the lower end portion of the body 2 is shown in greater detail in FIGS. 1, 3 and 4. This coupling is a quick-release coupling of the type known as bayonet mount and comprises a radially outwardly extending annular flange 25 provided on the body 2 and surrounding the port 46. The flange 25 has a set of preferably equidistant slots 26 each of which extends from its front or outer side **25*a* to its rear or inner side 25*b*. The slots 26 divide the flange 25 into an annulus of spaced-apart arcuate segments 27. The bayonet mount 24 further comprises a set of hook-shaped prongs 28 which are provided on the upper end portion of the housing 14 and can be caused to pass through the adjacent slots 26 when the generally cylindrical housing 14 is held in one of several predetermined angular positions with reference to the piston 5 and is caused to move axially toward the filter 7. Once the upper end portions of the hook-shaped prongs 28 have penetrated through the respective slots 26, the housing 14 is turned in a counterclockwise direction (to the left, as viewed in the developed view of FIG. 3 or 4) so that the uppermost portions of the prongs 28 engage the flange 25 from behind, i.e., they move behind the rear or inner sides 25*b* of the segments 27, whereby the housing 14 is safely coupled to the body 2. The rear or inner sides 25*b* of the segments 27 can constitute cam faces to ensure the establishment of a more reliable frictional engagement between such segments and the prongs 28. Detent means can be provided for releasably locking the housing 14 against angular movement from the position of FIG. 4. In order to disengage the housing 14 from the body 2, the operator rotates the housing in the opposite direction (i.e., in a direction to the right, as viewed in FIG. 4) in order to move the uppermost portions of the hook-shaped prongs 28 into register with the corresponding slots 26 whereupon the housing 14 can be moved axially downwardly or the body 2 can be moved upwardly to complete the separation of the parts 2 and 14 from each other. The construction of the coupling 23 is or can be identical with that of the coupling 24**.

In order to eliminate or reduce leakage, the body 2 of the four-way valve 1 is formed with internal grooves for ring-shaped sealing elements 29 and 30 which are respectively adjacent to the filters 6 and 7 and engage the external surface of the piston 5 at the opposite ends of the groove 12 for the inner end portion of the inlet 3. The larger-diameter end portions of the housings 13 and 14 respectively contain ring-shaped sealing elements 31, 32 which are biased against the adjacent end faces of the body 2 when the couplings 23, 24 are operative to connect the housings 13 and 14 to the respective ends of the body 2.

The lower housing 14 contains a shutoff valve 33 which includes a flap 35 pivotably mounted at 34 and movable between the solid-line (open) position and the broken-line (closed or sealing) position 36 of FIG. 1. When moved to the position 36, the flap 35 of the valve 33 seals the opening 47 which is defined by the second end portion or nipple 16 of the housing 14 so that the flap 35 serves as a rest for and entraps the cleaning elements 37 in the chamber 38 of the housing 14. The cleaning elements 37 gather in the chamber 38 because the piston 5 is held in the upper end position or they can be inserted by hand through the opening 39 in the larger-diameter upper end portion of the housing 14 as soon as the housing 14 is detached from the body 2 of the four-way valve 1. The opening 39 is thereupon used to admit a requisite quantity of a liquid medium (e.g., a sterilizing liquid or the cleaning agent which latter can contain one or more sterilizing substances) so that the cleaning elements 37 are at least partially submerged in the liquid medium and cannot be contacted by the surrounding air. This reduces the possibility of contamination of the cleaning elements 37. The housing 14 can be reattached to the valve body 2 as soon as the chamber 38 is at least partially filled with the liquid medium. The apparatus is ready for use as soon as the flap 35 is returned to the solid-line position in which it establishes a path for the advancement of cleaning elements 37 from the chamber 38 into the pipeline by way of the nipple 16. It will be noted that, in addition to its function of connecting the port 46 with the chamber 38 and the end 18 of a pipeline which requires cleaning, the housing 14 also serves as a depository or magazine for the supply of cleaning elements 37. This brings about a number of important advantages. Thus, the cleaning elements 37 cannot be misplaced and are invariably available when the cleaning operation is to begin. Secondly, the liquid medium which is confined in the chamber 38 after the flap 35 of the shutoff valve 33 is moved to the closed or sealing position 36 prevents direct contact between the cleaning elements 37 and the surrounding atmosphere so that the contamination of cleaning elements is highly unlikely or plain impossible, especially if the liquid medium is a sterilizing liquid. Furthermore, there is no need to provide a separate magazine for the storage of cleaning elements 37 when the apparatus is not in use or to use a fresh supply of cleaning elements at the start of each cleaning operation.

Another important advantage of the improved apparatus is that the end portions of the piston 5 and the outer sides of the filters 6, 7 therein are readily accessible by the simple expedient of detaching the housings 13 and 14 from the body 2. This enables an operator to remove impurities which accumulate at the outer sides of the filters 6 and 7. Such operation does not require the utilization of specially designed tools which contributes to lower cost of the apparatus. Still further, the cleaning elements 37 in the chamber 38 of the housing 14 or in the chamber of the housing 13 are readily accessible because the openings in the first end portions of the housings are large and the couplings 23 and 24 are designed in such a way that their parts do not extend into the openings which are defined by the respective end portions of the housings 13 and 14. For example, once the housing 14 is detached from the lower end portion of the body 2, the cleaning elements 37 therein can be expelled by the simple expedient of turning the detached housing 14 upside down. A finger can be inserted into the chamber 38 to extract one or more cleaning elements 37 for inspection, replacement or for another reason. The chambers of the housings 13 and 14 can be readily cleaned as soon as the respective couplings 23, 24 are caused to allow for disconnection of the housings from the body 2.

Still further, the piston 5 can be readily pushed by a finger to assume the desired end position as soon as the housings 13 and 14 are detached from the body 2. The piston 5 then remains in the selected end position because its external surface is in frictional engagement with the sealing elements 29 and 30 which are recessed into the body 2 of the valve 1.

The illustrated shutoff valve 33 can be replaced by any other suitable shutoff valve without departing from the spirit of the invention. For example, the pivotable flap 35 can be replaced with a valving element which is reciprocable between its sealing and inoperative positions. Moreover, the valve 33 or an analogous valve can be installed in the end 18 of the pipeline. As will be explained with reference to FIG. 5, the ends 17 and 18 of FIG. 1 or 2 can constitute detachable parts of the improved apparatus and each thereof can constitute a flexible hose or a rigid tubular body of selected length. One end portion of each such hose or rigid tubular body is connected to the nipple 15 or 16 and the other end portion of each hose or rigid tubular body is connected to the respective end of the pipeline which requires treatment.

An important advantage of the improved apparatus is that the cleaning elements 37 need not be withdrawn and stored in a separate storage area when the apparatus is not in use. Thus, the chamber 38 of the housing 14 can be used as a depository for the cleaning elements 37 and, when the shutoff valve 33 is closed and the chamber 38 is at least partially filled with a sterilizing liquid medium, the cleaning elements can remain in the chamber 38 for any desired interval of time without any danger of contamination because moisture cannot evaporate from their pores if they constitute spherical or otherwise configurated pieces of foam rubber or the like. The cleaning elements 37 are stored in close or immediate proximity to the valve so that the operator can immediately ascertain whether or not the housing 14 stores a requisite supply of cleaning elements to allow for a satisfactory cleaning operation. When necessary, the cleaning elements 37 can be readily and rapidly evacuated from the chamber 38 by the simple expedient of turning the housing 14 upside down. This is possible because the opening 39 is rather large and also because parts of the coupling 24 do not extend into the opening 39. The utilization of manually operated couplings 23 and 24 is desirable and advantageous because the operator need not employ any tools in order to attach or detach the housing 13 and/or 14 whenever the need arises and with a minimum of effort. Each of the housings 13, 14 can be said to constitute an adapter which has a larger-diameter opening adjacent to the body 2 of the valve 1 and a smaller-diameter opening which conforms to the opening in the respective end of the pipeline. As mentioned above, the housings or adapters 13, 14 are preferably dimensioned in such a way that they can be readily manipulated by hand, especially due to the provision of one or more ribs 21, 22, i.e., much more readily than in heretofore known apparatus wherein the flow reversing valve is directly connected to the ends of the pipeline by relatively small and hard-to-handle internally threaded caps or the like. The inner diameters of the nipples 15 and 16 can be small or even very small, depending on the inner diameters of the pipelines; this does not present any problems in connection with the attachment or separation of housings 13, 14 from the body 2 because the dimensions of those portions of the housings 13, 14 which are coupled to the body 2 can be selected solely with a view to ensure convenient attachment or detachment, i.e., irrespective of the inner diameters of the pipelines.

The provision of housings which are sufficiently large to facilitate convenient manipulation during attachment to or detachment from the body 2 of the four-way valve 1 constitutes a feature which can be resorted to independently of or jointly with the feature that the housing 14 or 13 constitutes a depository for cleaning elements 37 when the apparatus is not in use. The two features can be embodied in one and the same apparatus by the simple expedient of placing the housing (14) which is to serve as a magazine for cleaning elements at a level below the body 2 of the valve 1 and by providing such housing with the shutoff valve 33 or an analogous valve which ensures that the liquid medium for reception of cleaning elements when the apparatus is not in use cannot escape from the chamber of the respective housing.

The illustrated quick-release couplings 23 and 24 can constitute or can be replaced with couplings of the type used in many types of garden hoses to separably connect two sections of a composite hose to each other. The illustrated couplings are preferred at this time because the body 2 of the valve 1 need not be moved in order to attach the housing 13 or 14 thereto or to detach such housing from the body 2. In other words, all that is necessary to attach the housing 13 or 14 is to move the housing to one of several predetermined angular positions or to a single predetermined angular position, to thereupon move the housing axially and to turn the housing through a relatively small angle in order to engage the hook-shaped prongs 28 with the adjacent segments 27. Detachment of the housing 13 or 14 from the body 2 takes place by reversing the sequence of the just enumerated steps. The flanges 25 can be relatively thin so that a very short axial movement of the housing 13 or 14 suffices to move the outermost portions of the prongs 28 through the respective slots 26.

The parts 17, 18 can be integral with the housings 13 and 14 and the parts 17, 18 are then provided with couplings 40, 41 (see FIG. 5) for connection to the ends of a pipeline. This simplifies the manufacture of the housings 13, 14 and contributes to the convenience of manipulation of the housings during their attachment to or during their detachment from the body 2 of the valve 1. The couplings 23 and 24 are preferably placed close or very close to the respective end faces (outer sides of filters 6, 7) of the piston 5. This ensures that the major part of each housing can be grasped by hand for attachment to or for detachment from the body 2. The provision of external ribs 21, 22 is desirable and advantageous because the hand of the operator can apply a pronounced torque in order to properly engage the prongs 28 with the respective segments 27 or to disengage the prongs from such segments.

Figure 5:
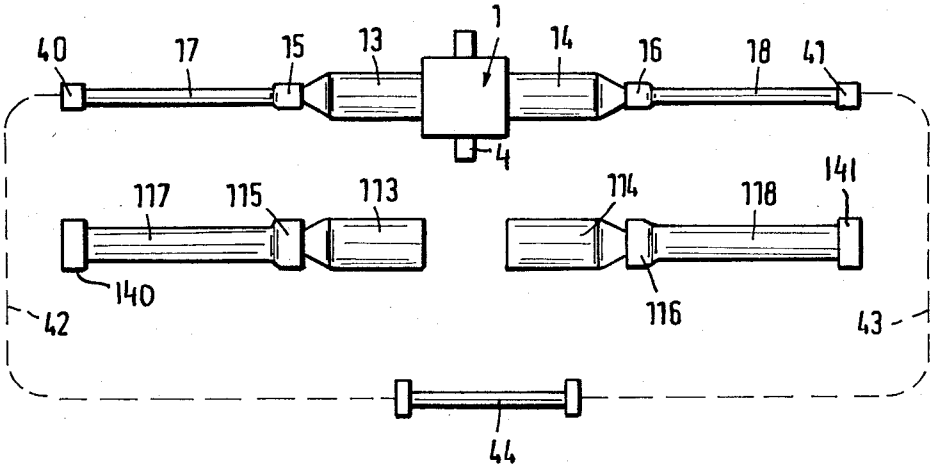
FIG. 5 is an elevational view of the apparatus of FIG. 1 and further showing a pipeline whose ends are connected to the apparatus as well as two spare housings which can be utilized when the inner diameters of the ends of a pipeline which requires cleaning deviate from the inner diameters of the ends of the illustrated pipeline.

FIG. 5 shows a modified apparatus which can be furnished with two or more spare housings 113, 114. The ends 17, 18 shown in the upper part of FIG. 5 can be said to constitute separable parts of the respective housings 13, 14 and their free outermost portions respectively carry the aforementioned couplings 40, 41 which can be used to attach the housings 13, 14 to the ends of a composite pipeline including two flexible or rigid conduits 42, 43 and an intermediate conduit 44 which is separably attached to the conduits 42, 43 so as to establish an uninterrupted path for the flow of a liquid cleaning agent from the valve 1 through the housing 13 and its part 17, conduits 42, 44, 43, housing 14 and to the outlet 4 or in the opposite direction. Each of the conduits 42, 43 can constitute a tube or a hose which serves to convey beer or another beverage to the tap within the reach of the bartender in a restaurant, in a bar, in a pub or in a similar establishment. For example, the intermediate conduit 44 can be connected between two taps while the other ends of the conduits 42, 43 are connected with the parts 17, 18 of the housings 13, 14 by the respective couplings 40, 41.

The housings 13, 14 can be used when the inner diameters of the conduits 42 and 43 are relatively small (e.g., in the range of 7 mm as is customary for the dispensing of beer or similar beverages). If the inner diameters of the conduits 42 and 43 are larger (e.g., in the range of 10 mm as is customary for delivery of nonalcoholic beverages to the taps on soda counters or the like), the housings 13 and 14 are detached from the valve 1 and are replaced with the spare housings 113, 114 whose larger-diameter portions are identical with those of the housings 13, 14 (so that they can be readily attached to the body of the valve 1 shown in FIG. 5) and whose parts 117, 118 have larger inner diameters (this is shown greatly exaggerated in FIG. 5 for the sake of clarity) so as to ensure that the outer ends of the parts 117, 118 can be properly attached to the adjacent ends of the conduits 42, 43 having inner diameters which are larger than those of the illustrated conduits 42 and 43. The couplings at the free ends of the parts 117, 118 are respectively denoted by the characters 140 and 141. The nipples 115, 116 of the housings 113, 114 are larger than the nipples 15, 16 of the housings 13, 14 so that they can be properly coupled to the respective ends of the parts 117, 118. In all other respects, the housings 13, 14 can be identical with the housings 113, 114. It is also clear that the apparatus can be furnished with two or more pairs of spare housings, depending on the number of different conduits which are to be cleaned with the improved apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for cleaning by means of a liquid cleaning agent and discrete cleaning elements in the form of sponges or the like a pipeline of the type having two ends with a predetermined inner diamter, comprising a four-way reversing valve including a body having an inlet for fresh cleaning agent, an outlet for spent cleaning agent and two ports arranged to communicate with the ends of the pipeline, and a piston reciprocable in said body between a first position in which said inlet and said outlet respectively communicate with one and the other of said ports and a second position in which said inlet and said outlet respectively communicate with said other and said one port; a housing including a first end portion with an inner diameter larger than, and a second end portion with an inner diameter closer to, said predetermined diameter, said first end portion of said housing being disposed at a level above said second end portion; a shutoff valve for selectively sealing and opening said second end portion so that supply of cleaning elements which are confined in said housing can be submerged in a liquid medium, particularly a sterilizing liquid, by admitting such medium through the first end portion while the shutoff valve seals the second end portion of said housing; and manually operated quick-release measn for releasably coupling the first end portion of said housing directly to said body so that the interior of the housing communicates with one of said ports in engaged condition of said coupling means and that said piston is accessible, in one of said first and second positions thereof, is disengaged condition of said coupling means, said second end portion being connectable with one end of the pipeline.

2. The apparatus of claim 1, further comprising a spare housing having a first end portion with an inner diameter matching the inner diameter of the first end portion of said first named housing and a second end portion of a diameter deviating from the inner diameter of the second end portion of said first named housing so that the second end portion of said spare housing can be connected with a pipeline having ends with inner diameters conforming to the inner diameter of the second end portion of said spare housing.

3. The apparatus of claim 1, wherein said coupling includes means for separably securing the first end portion of said housing to the body of said valve in response to movement of said housing with reference to said valve.

4. The apparatus of claim 1, wherein said end portions are integral with a median portion of said housing and said second end portion constitutes a nipple which is directly connectable with one end of the pipeline.

5. The apparatus of claim 1, wherein said piston has an end face and said coupling means is closely adjacent to such end face, at least when the piston assumes said position.

6. The apparatus of claim 1, wherein said housing is elongated and its length at least equals ten centimeters.

7. The apparatus of claim 1, wherein said housing has an external surface and at least one elongated rib extending from said external surface in a direction from one to the other of said end portions.

8. The apparatus of claim 1, further comprising a second housing which is identical with said first named housing and second coupling means for separably connecting the first end portion of said second housing to said body so that the first end portion of the second housing communicates with that port of said body which does not communicate with the first end portion of said first named housing, the second end portion of said second housing being connectable with the other end of a pipeline one end of which is connected or connectable with the second end portion of said first named housing.

9. Apparatus for cleaning finite-length pipelines for beverages or the like by means of a liquid cleaning agent and discrete cleaning elements in the form of sponges or the like, comprising a four-way reversing valve including a body having an inlet for fresh cleaning agent, an outlet for spent cleaning agent and first and second ports arranged to communicate with the ends of a pipeline, and a valving element movable in said body between a first position in which said inlet and said outlet respectively communicate with said first and said second port and a second position in which said inlet and said outlet respectively communicate with said second and said first port; a filter mounted on and being movable with said valving element, said filter being located in the path of flow of cleaning agent through one of said ports; a housing defining a chamber for storage of a supply of cleaning elements and having a first opening affording access to said chamber and a second opening providing a path for the flow of cleaning agent and for advancement of cleaning elements between said chamber and one end of a pipeline; means for releasably coupling said housing to said body so that the first opening is adjacent to said body and said chamber is sealed from the surrounding area and communicates with said one port in engaged condition of said coupling means and said valving element and said filter are accessible, in one of said first and second positions of said valving element, when said coupling means is disengaged; and means for selectively sealing and unsealing said second opening so that, when the second opening is sealed, the supply of cleaning elements in said chamber can be at least partially submerged in a liquid medium, such as a sterilizing liquid.

10. The apparatus of claim 9, wherein said first opening is disposed at a level above said second opening and said means for selectively sealing and unsealing said second opening comprises a shutoff valve in said housing, the liquid medium being introduced into said chamber upon separation of said housing from said body and subsequent to movement of said shutoff valve to closed position.

11. The apparatus of claim 9, wherein said housing has a nipple which defines said second opening and is connectable with one end of a pipeline.

12. The apparatus of claim 9, wherein said housing is elongated and has a length of at least ten centimeters.

13. The apparatus of claim 9, wherein said housing is elongated and has an external surface provided with at least one longitudinally extending rib.

14. Apparatus for cleaning finite-length pipelines for beverages or the like by means of a liquid cleaning agent and discrete cleaning elements in the form of sponges or the like, comprising a four-way reversing valve including a body having an inlet for fresh cleaning agent, an outlet for spent cleaning agent and first and second ports arranged to communicate with the ends of a pipeline, and a valving element movable in said body between a first position in which said inlet and said outlet respectively communicate with said first and said second port and a second position in which said inlet and said outlet respectively communicate with said second and said first port; a filter disposed in the interior of said body in the path of flow of cleaning agent through one of said said ports; a housing defining a chamber for storage of a supply of cleaning elements, said housing including a first end portion defining a first opening which affords access to said chamber and a second end portion defining a second opening which provides a path for the flow of cleaning agent and for advancement of cleaning elements between said chamber and one end of a pipeline, the inner diameter of said first end portion exceeding the inner diameter of said second end portion; means for sealingly coupling said housing to said valve so that said chamber communicates with said one port by way of said first opening, said coupling means comprising a manually operated device for separably securing the first end portion of said housing to said valve so that said valving element and said filter are accessible upon separation of said first end portion from said valve; and means for selectively sealing and unsealing said second opening so that, when the second opening is sealed, the supply of cleaning elements in said chamber can be at least partially submerged in a liquid medium, such as a sterilizing liquid.

15. Apparatus for cleaning by means of a liquid cleaning agent and discrete cleaning elements in the form of sponges or the like a pipeline of the type having two ends with a predetermined inner diameter, comprising a four-way reversing valve including a body having an inlet for fresh cleaning agent, an outlet for spent cleaning agent and two ports arranged to communicate with the ends of the pipeline, and a piston reciprocable in said body between a first position in which said inlet and said outlet respectively communicate with one and the other of said ports and a second position in which said inlet and said outlet respectively communicate with said other and said one port; a housing including a first end portion with an inner diameter larger than, and a second end portion with an inner diameter closer to, said predetermined diameter; and manually operated quick-release means for releasably coupling the first end portion of said housing directly to said body so that the interior of the housing communicates with one of said ports in engaged condition of said coupling means and that said piston is accessible, in one of said first and second positions thereof, in disengaged condition of said coupling means, said second end portion being connectable with one end of the pipeline and said coupling means including a bayonet mount.

16. The apparatus of claim 15, wherein said housing includes a cylinder and said mount is arranged to connect said housing to or disconnect said housing from said body in response to rotation of said cylinder about its axis.

17. The apparatus of claim 16, wherein said mount includes a flange provided on said body, surrounding one of said ports and having circumferentially spaced-apart slots, said mount further including hook-shaped prongs which are provided on the first end portion of said housing and each of which is insertable through one of said slots in at least one predetermined angular position of said cylinder with reference to said body and each of which engages said flange from behind in response to angular movement of said cylinder from said predetermined position while said prongs extend through the respective slots.

* * * * *